United States Patent [19]

Brook

[11] 4,264,655

[45] Apr. 28, 1981

[54] ENCAPSULATED IMPREGNATED ROVINGS

[75] Inventor: Richard L. Brook, Mount Prospect, Ill.

[73] Assignee: DeSoto, Inc., Des Plaines, Ill.

[21] Appl. No.: 67,380

[22] Filed: Aug. 17, 1979

Related U.S. Application Data

[62] Division of Ser. No. 673,724, Apr. 5, 1976, Pat. No. 4,187,347, which is a division of Ser. No. 557,656, Mar. 12, 1975, Pat. No. 4,220,686.

[51] Int. Cl.[3] ..... D02G 3/00; B05D 1/36; B05D 3/02; B05D 7/00

[52] U.S. Cl. ..... 427/381; 427/389.8; 427/389.9; 427/407.3; 427/412

[58] Field of Search ..... 138/103, 109, 141; 427/389.8, 407.3, 381, 389.9, 412; 428/375, 367, 372, 378, 394, 395, 397, 415, 414, 524

[56] References Cited

U.S. PATENT DOCUMENTS

| | | | |
|---|---|---|---|
| 3,323,176 | 6/1967 | Naegeli | 19/66 |
| 3,576,705 | 4/1971 | Goldsworthy | 428/392 X |
| 3,586,058 | 6/1971 | Ahrens et al. | 138/103 |
| 3,679,507 | 7/1972 | Marzocchi | 428/378 X |
| 3,775,150 | 11/1973 | McClary et al. | 156/110 A |
| 3,806,483 | 4/1974 | Juba et al. | 260/29.6 NR |
| 3,862,882 | 1/1975 | Marzocchi | 260/37 EP |
| 3,895,163 | 7/1975 | Elmer | 428/295 |
| 4,050,230 | 9/1977 | Senou et al. | 57/149 |

*Primary Examiner*—Michael R. Lusignan

*Attorney, Agent, or Firm*—Dressler, Goldsmith, Shore, Sutker & Milnamow. Ltd.

[57] ABSTRACT

Rovings impregnated with solid or preferably semi solid thermosetting resin and which can be handled in textile processing equipment are provided by overcoating the impregnated roving with a thermoplastic resin dispersed in a volatile liquid medium which does not dissolve the thermosetting resin to form an encapsulating membrane of thermoplastic resin around the impregnated roving to thereby provide the strength, flexibility, and surface properties needed for textile handling without degrading the properties desired in the final cured molded product.

10 Claims, No Drawings

ENCAPSULATED IMPREGNATED ROVINGS

This is a division of application Ser. No. 673,724, filed Apr. 5, 1976, now U.S. Pat. No. 4,187,347 patented Feb. 5, 1980, which in turn is a division of Ser. No. 557,656, filed Mar. 12, 1975, now U.S. Pat. No. 4,220,686, patented Sept. 2, 1980.

The present invention relates to resin impregnated fibrous material in the form of a strand or roving which is useful in the production of molded laminates.

Resin impregnated fibrous material for the production of molded laminates is known and illustrated in U.S. Pat. No. 3,586,058, assigned to McDonnell Douglas Corporation, where a roving is described as being braided to form a duct or other hollow body without seams, and a thermosetting resin is applied to the roving either before or after braiding.

The art has desired to be able to apply the resin to the roving in liquid form and then solidify the resin to provide a fibrous roving preimpregnated with a solid thermosetting resin suitable for subsequent braiding or other textile sheet-forming operation, but the impregnated rovings heretofore available were not satisfactory, either because the cured properties were poor, or because the resin in solidified form would not permit ordinary textile handling.

This invention is concerned with the provision of an intermediate material in the form of a fibrous roving impregnated with a thermosetting curable resin in solid form, or preferably in semi solid form, which is handleable in textile processing equipment so as to be woven or braided into sheet form for subsequent curing. Braiding can be continuous about a hollow form, as in U.S. Pat. No. 3,586,058, or one can simply provide sheet material for storage and subsequent fabrication using heat and pressure to cause the thermosetting resin impregnant to flow and form a unitary resinous mass, followed by curing to a heat and solvent resistant composite.

It is desired to point out that a preimpregnated fibrous roving, strand or yarn in which the heat curable thermosetting resin impregnant is in solid form to permit handling in textile machines, such as braiding or knitting machines, can suffer from various inadequacies. Thus, some heat curable, thermosetting resins are stiff and friable. Others provide a tacky surface, or a surface which exhibits high friction in contact with the operating portions of textile machinery. Still others exhibit poor flow when heated so that they cannot be successfully molded into nonporous and homogeneous laminates. As a result, efforts to provide preimpregnated rovings and the like using existing heat curable thermosetting resins have not been fully successful in commerce.

In accordance with this invention, it has been found that by encapsulating the fibrous roving which contains a heat curable thermosetting resin impregnant in solid, or preferably in semi solid form within the fibrous body of the roving within a thin membrane of solid thermoplastic resin, one can obtain an intermediate product which has the physical and mechanical properties which enable successful textile operations, such as machine braiding, to be accomplished. So long as the thermoplastic material constituting the membrane is applied from a volatile liquid medium which does not dissolve the uncured thermosetting resin within the roving, then the encapsulated thermosetting resin remains distinct from the thermoplastic resin, and the desirable surface properties provided by the thermoplastic encapsulating resin and which enable handling in subsequent textile machines, are not altered by premature mixing with the impregnated resin.

It is desired to stress that the use of a semi solid thermosetting resin impregnant is of particular importance in this invention. Solid resins provide provide stiff impregnated rovings. In the absence of this invention, these stiff rovings are damaged when they are wound and unwound on rollers and handled on textile machines in that the solid uncured thermosetting resin is usually brittle and flakes off, and the fibers of the roving are broken. Encapsulation as in this invention greatly reduces flake-off, and improves surface lubricity, and this is a significant step forward, but some fiber damage is still encountered. The strongest molded products are formed when breakage of the reinforcing fibers is minimized.

When the semi-solid resin is encapsulated in accordance with this invention, it can be wound, stored, unwound and used in textile machines, and resin flake-off is largely eliminated and fiber breakage is minimized. At the same time, the semi solid resin still exhibits the superior flow on subjection to heat and pressure which it normally possesses.

The term "semi-solid" is intended to define a highly viscous mass which is sufficiently resistant to flow at room temperature that it does not readily transfer off the roving. A room temperature viscosity of at least about 30,000 centipoises is generally required for this purpose. On the other hand, semi solid resins possess sufficient room temperature flow that an unencapsulated impregnated roving, when wound for storage, could not be satisfactorily unwound since the viscous resin impregnant in the various windings would flow together on sustained contact causing interstrand adhesion. This adhesion does not occur after encapsulation in thermoplastic resin in accordance with this invention. This problem of coalescence of the thermosetting resin impregnant on storage also occurs in some instances with resins considered to be solid, and this difficulty is also overcome in this invention.

The term "thermoplastic" as used herein denotes a solid resin which is soluble and coalescable, but which possesses such high molecular weight and room temperature solidity as to provide a tough encapsulating skin. This skin is applied without dissolving the encapsulated thermosetting resin. The thermoplastic resin will not normally be capable of self-curing. In some instances some limited thermosetting characteristic can be tolerated without disturbing the physical properties normally associated with thermoplastic resins. An an illustration, Nylon 66 is a thermoplastic resin of high molecular weight and excellent physical characteristics. Nylon 66 can be reacted with formaldehyde and then alkylated, as with ethyl alcohol, to provide an alcohol soluble polymer of good properties which is useful as an encapsulating resin herein. However, the modified Nylon 66 polymer insolubilizes on baking by release of the etherifying alcohol and water, and it is useful herein. Thus, the term "thermoplastic" embraces such high molecular weight resins modified to include some thermosetting characteristics.

The term "roving" is used broadly herein to embrace fibrous strands, yarns, threads and tapes, twisted or untwisted. Untwisted flat fibrous rovings are particularly preferred.

Following the textile operation in which the impregnated and encapsulated roving is braided, woven, or otherwise processed on a textile machine to provide a fabricated sheet, heat and pressure are applied to one or more of the sheets in order to cause the two resins to flow and thereby provide the desired cured molded product. When the resins flow in the molding operation, the thin membrane of encapsulating thermoplastic resin is sufficiently disrupted to permit the thermosetting resin to flow and merge providing a unitary and nonporous molding. In some instances, the two resins merge which requires compatibility of the two resins in hot melt form, and there are many compatible combinations which can be provided, as will be illustrated hereinafter, and as will be evident to those skilled in the art.

It is desired to point out that the intrinsic nature of a resin which can flow well under molding conditions and which develops its properties upon chemical reaction, i.e., a thermosetting resin, makes it poorly adapted to provide a flexible, tough and nontacky structure as is needed for machine processing. Correspondingly, thermoplastic resins are of higher molecular weight and possess good strength, flexibility, and low tack surface characteristics which permit textile machine processing. This invention is founded on the discovery that a thin encapsulating membrane of the thermoplastic resin will impart a sufficient overall improvement in the strength, flexibility, and surface resistance to the impregnated roving without merging into the uncured thermosetting impregnant on application, but does not prevent coalescence of the encapsulated thermosetting resin on subsequent application of heat and pressure so as to form a unitary and nonporous final molded product.

The encapsulating thermoplastic resin can be selected to be nontacky, but some surface tackiness is tolerable and can be accepted by dusting the somewhat tacky surface with an organic or inorganic powder, illustrated by talc.

The specific nature of the thermosetting resin impregnant is of secondary consideration, heat hardening phenolic resins and aminoplast resins all being useful. Epoxy resins are particularly satisfactory, and these are used in admixture with curing agents which are preferably inert until heat activated, such as dicyandiamide, to permit prolonged storage prior to use. Thus, the thermosetting resin can be self curing, or curing agents or catalysts can be added as desired.

Thermoplastic resins may be present in admixture with the thermosetting resin to provide desired final properties in the cured molded product. This will be illustrated by a carboxyl-terminated butadiene acrylonitrile copolymer containing 10–40%, preferably 15–30%, of acrylonitrile, which add physical toughness (impact resistance) to the molded products which are formed. These copolymers are liquid to rubbery in nature and are used in an amount of from 1–30%, preferably 4–20%, based on the weight of the thermosetting resin. The corresponding amine terminated butadiene acrylonitrile copolymers are also useful to provide enhanced toughness without degrading other properties.

The thermosetting resin can be applied in any desired manner, using solvents which are volatilized, or by hot melt application, so long as the conditions of application are sufficiently moderate or employed for such a short time as to avoid premature curing. This invention will be illustrated by application of the thermosetting resin from organic solvent solution in methylene chloride solvent which is evaporated after impregnation at 250° F. for 30 seconds. For more rapid application, higher temperatures for shorter periods are available, e.g., 300° F. for 20 seconds.

The thermoplastic resin is applied from a volatile liquid medium which does not dissolve the thermosetting resin. Using an epoxy resin as the thermosetting resin impregnant, (diglycidyl ether of bisphenol A), alcohols, such as methanol, dissolve the thermoplastic resin while having very little dissolving capacity for the thermosetting resin. The epoxy-impregnated roving is then overcoated with a solution of a solvent soluble nylon polymer in methanol which forms a membrane above the roving. The epoxy resin is not drawn into the nylon membrane which remains intact to provide a flexible and tough sheath around the roving to permit subsequent textile processing. The solvent soluble nylon may possess some surface tack immediately after application and drying, but this difficulty can be handled with a dusting powder or by storage to permit conversion of the nylon to the crystalline state.

The solvent soluble nylon polymers noted above are known commercially available resins. For example, duPont provides these under the trade designations "Elvamide" 8061, 8063, and 8064, these being described as nylon resins which are alcohol-soluble polyamides. These can be used herein from alcohol solution, or from aqueous dispersion, these aqueous dispersions being also available in commerce.

While solvent application in an alcohol is preferred, hydrocarbon solvents will further illustrate volatile liquids which can dissolve thermoplastic resins and which have little solvency for most thermosetting resins. This is illustrated by the application of polyethylene dissolved in refluxing hexane.

Water can also be used as the volatile liquid as noted briefly hereinbefore. Thus, acidic resins, such as copolymers of ethyl acrylate with about 10% of acrylic acid can be dissolved in water with the aid of a base (usually a volatile amine such as triethyl amine) to form solutions which may be regulated in solids content in order to provide whatever encapsulating thickness is desired. A 25% solids solution is typical. Emulsion copolymers can also be used, such as a copolymer of vinyl acetate with about 15% of butyl acrylate.

Thus, in addition to solvent soluble or water dispersible polyamides, one can also use corresponding polyesters, polyesteramides, and acrylic copolymers as the thermoplastic polymers, and these can be dissolved in organic solvent or water or applied in suspension as desired.

Thermosetting resins useful herein are further illustrated by unsaturated polyester-styrene mixtures, melamine formaldehyde condensates and urea formaldehyde condensates. The unsaturated polyester resins noted above may be polyesters of maleic anhydride and ethylene glycol.

It is particularly preferred to employ an encapsulating thermoplastic resin which contains active hydrogen atoms which can react with the functional groups provided by the thermosetting resin. Thus, while the thermosetting resin preferably carries N-methylol or epoxy functional groups, the encapsulating thermoplastic resin preferably carries carboxyl, hydroxyl or amido groups to provide active hydrogen. In this way, on curing the encapsulated impregnated roving, the thin membrane of thermoplastic resin flows into and merges with the molten thermosetting resin during cure and reacts therewith to avoid separation of the respective resins in the cured molded product. Instead, the resinous mass formed by curing no longer contains clearly defined portions of encapsulating membrane.

To further illustrate the thermoplastic resins containing active hydrogen, reference is made to a saturated polyester resin possessing both carboxyl and hydroxyl functionalities formed by polyesterifying 1 mol of ethylene glycol, 1 mol of glycerin and 2 mols of phthalic anhydride. Similarly, a copolymer of 80 parts of styrene with 15 parts of 2-hydroxy ethyl acrylate and 5 parts of acrylic acid can be used. The hydroxy ethyl acrylate can be replaced with acrylamide. Solid phenol formaldehyde novolacs are also valuable to provide a thermoplastic resin useful herein which includes hydroxy groups which are capable of reaction in the final cure. Phenol formaldehyde novolacs contain too little formaldehyde to be self curing under the processing conditions used herein and have a molecular weight up to about 1000. These novolacs are particularly desirable for the encapsulation of epoxy resin-dicyandiamide mixtures.

Rovings of generally rectangular cross section are particularly contemplated, and these may be formed as follows, starting with the unimpregnated fibrous roving stored on a roll or spool on which the roving naturally assumes a generally rectangular cross section. The roving is withdrawn from storage and passed under tension through a bath of thermosetting resin in solution to impregnate the roving which is then dried to evaporate the solvent by passage through an oven providing an impregnated roving which has been rounded by the impregnation operation. The impregnated roving, still warm from the drying step, is passed between nip rolls surfaced with a low energy material, such as Teflon, which imparts a rectangular cross section. The semi solid nature of the thermosetting resin impregnant at room temperature makes the warm impregnated roving easy to shape, and this allows one to shape the roving while minimizing damage to the fibers.

The invention is illustrated in the example which follows.

EXAMPLE 1

A resin solution useful in the provision of impregnated rovings is prepared as follows:

1500 parts by weight of polysulfone thermoplastic polymer (see note 1) were dissolved in 7000 parts of methylene chloride solvent. 500 parts of epoxy resin which is a diglycidyl ether of bisphenol A having an epoxy equivalent weight of 188 (see note 2), 250 parts of dicyandiamide, and 2150 parts of methylene chloride were combined to form a solution, and charged into a berylite mill to reduce the particle size of the crystalline dicyandiamide curing agent, and to evenly disperse it in the epoxy resin solution (North Standard 6.5 Hegman grind gauge). After 18 hours of grinding the contents of the mill were transferred to the polysulfone polymer-solvent solution, along with an additional 3000 parts of the previously noted epoxy resin and 2050 parts of additional methylene chloride. The resulting solution was stirred and then stored in a sealed container until used.

A membrane solution was prepared, as will now be described.

1880 parts of methanol solvent were warmed to reflux temperature and to the warm solvent were gradually added with vigorous stirring, 120 parts of solvent soluble Nylon polymer (see note 3). The solution was stirred until the polymer was completely in solution, and then it was cooled to 75° F. and stored in a sealed container until needed.

A dusting powder was prepared as follows:

950 parts of finely divided magnesium silicate and 50 parts of 5 micron graphite were combined and stirred until uniform.

A machine braidable preimpregnated roving was prepared as follows.

Graphite roving (see note 4) was passed through an impregnation bath of the impregnating epoxy resin solution prepared hereinbefore and then oven dried at 250° F. for 30 seconds to remove solvent and leave a semi solid resin around the fibers. The volatile free graphite-resin impregnated roving was then passed through a bath of the membrane solution prepared hereinbefore and oven dried at 250° F. for 30 seconds. The membrane solution formed a thin, uniform encapsulating membrane around the preimpregnated product. The encapsulated preimpregnated product was then rolled out to ⅛ inch wide ribbon, and the ribbon was dusted with the above-prepared dusting powder. Excess dust was removed to give a high lubricity, tack-free polymer membrane surface over the graphite roving-resin.

The encapsulated impregnated roving thus formed is an intermediate product, and it was wound into braider packages for storage. These braider packages were later unwound to supply a textile braiding machine and, in a test run, a complex aircraft part was successfully braided and molded as described in U.S. Pat. No. 3,586,058.

Note 1—Union Carbide Product P-1700 can be used. It has the formula:

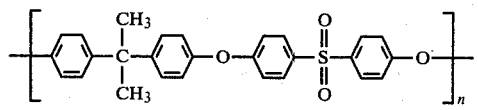

where n=about 90.

Note 2—Epon 828 (Shell) or Araldite 6010 (Ciba) may be used.

Note 3—DuPont product Elvamide 8061 can be used. This polymer melts at 157° C. (Fisher-Johns) and elongates 300% at 73° F. before breaking. Its tensile strength at 73° F. is 7,400.

Belding product BCl 819 Nylon-methoxy methyl substituted Nylon 6:6 (from adipic acid and hexamethylene diamine) may also be used.

Note 4—10,000 continuous filament graphite roving - Hercules product graphite fiber type AS may be used. Union Carbide product Thornel 300 may also be used.

EXAMPLE 2

An impregnation resin solution was prepared in the following manner:

A. 200 grams of liquid epoxy resin—diglycidyl ether of bisphenol A having an epoxy value of about 0.52 and a viscosity of about 14,000 cps. at 25° C. (Ciba product Araldite 6010 may be used) and 1000 grams of solid epoxy resin—diglycidyl ether of bisphenol A having an epoxy value of about 0.20, were combined in a resin kettle fitted with a water cooled condenser. Epoxy value is measured in equivalents per 100 grams of resin.

B. The resin mixture was warmed with stirring to 200° F. to melt the solid epoxy resin and to form a solution of the two epoxy resins. The warm resin blend was solvated with 550 grams of methylene chloride and cooled to 75° F.

C. In a separate vessel 150 grams of carboxy-modified acrylonitrile- butadiene crumb rubber (25% acrylonitrile) were combined with 600 grams of methylene chloride solvent. The two components were stirred until a uniform solution of the rubber was obtained. B. F. Goodrich product Hycar 1472 may be used as the crumb rubber.

D. The rubber solution was combined with the epoxy solution from step B above and stirred until uniform.

E. Fifty-five grams of dicyandiamide curing agent, 85 grams of the previously described liquid epoxy resin, and 200 grams of methylene chloride solvent were combined in a glass jar along with glass beads and the jar placed on a paint shaker to disperse the curing agent and to reduce its particle size. A grind having a fineness of 6.5 on the North Standard scale of the Hegman Grind Gauge was obtained.

F. The grind of step E was combined with the solution of step D and stirred until homogeneous. An additional 2090 grams of methylene chloride solvent were added to reduce viscosity.

G. A membrane solution of solid phenol formaldehyde novolac resin containing about 5 phenyl groups per molecule in methanol was made by adding 333 grams of the novolac resin powder to 667 grams of methanol with stirring. The commercial novolac 27827 Durez R-1 may be used.

H. Electrical grade continuous strand glass roving (Owen/Corning 836AA 675 may be used) was passed through an impregnation bath containing the above impregnation resin solution and then oven dried at 300° F. for 30 seconds to remove the methylene chloride. The resin content of the solvent-free impregnated glass roving was 33% by weight.

I. The novolac solution was applied to the impregnated strand formed in step H and mechanically wiped to leave a thin solution of membrane polymer on the surface. The novolac solution coated roving was oven dried at 180° F. for 30 seconds. A clear, glossy and tack-free surface was obtained.

J. The encapsulated roving thus formed was wound into standard braider packages (Owens Corning Package Number 4011). The encapsulated roving could be freely unwound from the braider packages whereas control packages prepared in exactly the same manner, but without the protective novolac membrane, were firmly blocked together, and nearly impossible to unwind without damaging the rovings. Molded objects prepared from the encapsulated roving described above exhibited good flow and mechanical strengths when cured at 350° F. for one hour.

EXAMPLE 3

The resin solution described in Example 1 was used to impregnate continuous strand fiberglass roving weighing 0.2242 grams per foot. The resin solution impregnated roving was dried in an oven for 36 seconds at 250° F. and then treated with a thin coating of polyvinyl butyral dissolved in methanol. The membrane solution was prepared by dissolving 90 grams of polyvinyl butyral (having a molecular weight average of about 32,000, an hydroxyl content of about 19% expressed as polyvinyl alcohol, a maximum acetate content of 2.5% expressed as polyvinyl acetate, and a butyral content of 80% expressed as polyvinyl butyral) in 910 grams of methanol. Monsanto product Butvar B-98 may be used. The membrane coating was dried at 250° F. for 36 seconds.

The resulting encapsulated fiberglass roving could be wound into braider packages of the type noted previously, which later during machine braiding unwound readily. The braided composite fabric formed from the encapsulated roving was molded at 350° F. for 1 hour to form strong, smooth and void-free composite parts.

The invention is defined in the claims which follow.

I claim:

1. A method of producing a fibrous roving impregnated with thermosetting resin in uncured semi-solid form encapsulated within a thin membrane coating of thermoplastic coating, comprising impregnating fibers with a thermosetting epoxy resin composition dissolved in organic solvent and evaporating the solvent to provide a solid impregnated fibrous roving containing said epoxy resin composition in semi-solid form, overcoating said impregnating roving with a solid phenol-formaldehyde novolac dissolved in a volatile alcohol, and then vaporizing said alcohol without curing said epoxy resin to provide a continuous membrane coating of said solid novolac at the surface of said roving.

2. A method as recited in claim 1 in which said volatile alcohol is methanol.

3. A method as recited in claim 1 in which said epoxy resin composition is dissolved in methylene chloride.

4. A method of producing a fibrous roving impregnated wih thermosetting resin in uncured semi-solid form encapsulated within a thin membrane coating of thermoplastic resin comprising overcoating said roving impregnated with semi-solid thermosetting resin with a thermoplastic resin dispersed in a liquid medium which does not dissolve said thermosetting resin, and then vaporizing said liquid medium without curing said thermosetting resin to provide a continuous film of said thermoplastic resin around said impregnated roving while the encapsulated thermosetting resin remains distinct from said thermoplastic resin.

5. A method as recited in claim 4 in which said epoxy resin is in admixture with a thermoplastic resin.

6. A method as recited in claim 4 in which said epoxy resin is in admixture with dicyandiamide.

7. A method as recited in claim 6 in which said liquid medium is water.

8. A method as recited in claim 6 in which said liquid medium is methanol.

9. A method as recited in claim 4 in which said thermoplastic resin is compatible in a hot melt with said epoxy resin.

10. A method as recited in claim 9 in which said thermoplastic resin contains reactive groups selected from the group consisting of carboxyl, hydroxyl and amido groups.

* * * * *

UNITED STATES PATENT AND TRADEMARK OFFICE

CERTIFICATE OF CORRECTION

PATENT NO. : 4,264,655

DATED : Apr. 28, 1981

INVENTOR(S) : Richard L. Brook

It is certified that error appears in the above-identified patent and that said Letters Patent are hereby corrected as shown below:

Col. 8, line 39 (claim 4, line 5), after "thermosetting" insert --epoxy--

Signed and Sealed this

*First* Day of *September 1981*

[SEAL]

*Attest:*

GERALD J. MOSSINGHOFF

*Attesting Officer*

*Commissioner of Patents and Trademarks*